US006183237B1

(12) United States Patent
Blanchard et al.

(10) Patent No.: US 6,183,237 B1
(45) Date of Patent: Feb. 6, 2001

(54) CEMENT SLAB SURFACE BEVELING DEVICE

(76) Inventors: David A. Blanchard, 14032 - 300th Ave., Frazee, MN (US) 56544; James Johnson, 27381 Rice Lake Rd., Detroit Lakes, MN (US) 56501

( * ) Notice: Under 35 U.S.C. 154(b), the term of this patent shall be extended for 0 days.

(21) Appl. No.: 09/260,829

(22) Filed: Mar. 2, 1999

(51) Int. Cl.[7] ..... B28B 11/08
(52) U.S. Cl. ..... 425/458; 15/235.4; 15/235.7
(58) Field of Search ..... 425/87, 458; 15/235.4, 15/235.7, 235.8

(56) References Cited

U.S. PATENT DOCUMENTS

| | | | | |
|---|---|---|---|---|
| 761,242 | | 5/1904 | Meyers | 15/235.7 |
| 1,347,938 | | 7/1920 | Conelly | 15/235.7 |
| 1,390,126 | * | 9/1921 | Halaska, Jr. | 425/458 |
| 1,490,094 | * | 4/1924 | Daly | 15/235.7 |
| 2,179,563 | * | 11/1939 | Sassano | 15/235.8 |
| 2,198,974 | * | 4/1940 | Pilant | 15/235.4 |
| 2,385,149 | * | 9/1945 | Martines | 425/458 |
| 2,526,401 | * | 10/1950 | Oscar | 15/235.8 |
| 2,730,756 | * | 1/1956 | Greene | 425/458 |
| 4,737,097 | | 4/1988 | Cotugno | 425/458 |
| 4,766,635 | | 8/1988 | DeVitis | 425/458 |
| 5,269,675 | | 12/1993 | Cox | 425/458 |
| 5,632,569 | * | 5/1997 | Szmansky | 15/235.4 |

FOREIGN PATENT DOCUMENTS

| | | | | |
|---|---|---|---|---|
| 387272 | * | 12/1923 | (DE) | 425/458 |

* cited by examiner

*Primary Examiner*—Robert Davis
(74) *Attorney, Agent, or Firm*—David A. Lingbeck

(57) ABSTRACT

A cement slab surface beveling device including a plate-like support member having a second end, a bottom surface, a first exposed flat portion of the bottom surface, and a second exposed flat portion of the bottom surface; and further including a handle member attached to the support member, and a tapered beveling member attached to the bottom surface of the support member and having an end spaced from the second end of the support member and having a bottom edge and a flat bottom surface extending at an angle from the bottom edge to the bottom surface of the support member. The first exposed flat portion is placed upon a cement slab frame used to form the cement slab and the second exposed flat portion is placed upon the cement slab surface with the beveling member disposed in the semi-harden cement. The beveling device is moved upon the cement slab frame from one side to the other side with the beveling member removing and displacing a portion of the cement to form the beveled surface at the end of the cement slab.

3 Claims, 2 Drawing Sheets

CEMENT SLAB SURFACE BEVELING DEVICE

BACKGROUND OF THE INVENTION

This invention relates to a cement slab surface beveling device, in particular, for beveling along the edge or end of a cement floor during the formation thereof.

Cement floors, in particular, are typically beveled along at least one end thereof especially garage floors where the ingress and egress to the garage floor are typically beveled because the floors are raised above the ground surface to substantially prevent water from getting on the garage floor from the outside, and the beveled surface not only facilitates runoff of the water but also allows vehicles to easily enter upon the garage floor.

One prior art is a TOOL FOR FORMING A BEVELED EDGE ON CEMENT WORK, U.S. Pat. No. 5,269,675, invented by Jerry W. Cox and issued on Dec. 14, 1993, and which comprises a tool body having a flat bottom surface for engaging a flat top surface of soft cement contained in cylindrical form and further having a downwardly-turned lip extending from a first end to a second end and being of a generally wedge-shaped structure.

Another known prior art is an INTERIOR EDGE-EDGER, U.S. Pat. No. 4,766,635, invented by Louis Devitis and issued on Aug. 30, 1988, and which comprises a flat inflexible rectangular plate shaped such the shorter leading edge and trailing edge curve upward and one of the longer edges has a central portion curving outward and downward.

Another known prior art is a CONCRETE SLAB SURFACE FINISHING TOOL, U.S. Pat. No. 4,737,097, invented by Joseph A. Cotugno and issued on Apr. 12, 1988, and which comprises a flat floor surface working area, a lip offset surface working area joined to the flat floor surface working area, a flat lip surface working area joined to the lip offset working area, and edge surface working area joined to the flat lip surface working area.

Another known prior art is a CONCRETE EDGING AND MARKING TOOL, U.S. Pat. No. 1,347,938, invented by H.F. Conelly and issued on Jul. 27, 1920, and which comprises a rectangular body, upward extending arms, inwardly extending pivot pins carried by the arms, the inner edges of the body having openings for rotatably receiving the pivot pins with one of the arms having inwardly extending lugs positioned on the opposite sides of the pivot pin, a hand grip connected to the arms, and a spring mounted about a bolt used to connect the hand grip to the arms.

Another known prior art is a TROWEL, U.S. Pat. No. 761,242, invented by George Meyers and issued on May 31, 1904, and which comprises a blade, a handle, and an attachment provided with ears adapted to enter orifices in the blade and held therein by clamps.

None of the prior art discloses or suggests a cement slab beveling device of the type described and claimed herein.

SUMMARY OF THE INVENTION

The present invention relates to a cement slab surface beveling device which comprises a plate-like support member having a bottom surface, a top side, a first end and a second end; and also comprises a handle member fastened to the top side of the plate-like member; and further comprises a tapered beveling member which extends downwardly from the bottom surface of the support member and which has an end, a bottom edge and a flat bottom surface which is angled relative to the flat bottom surface of the support member.

Once the cement slab is poured and allowed to semi-harden, the user slides the cement slab surface beveling device along the edge of the floor with a second exposed flat portion of the bottom surface of the support member being movably supported upon the slab surface and a first exposed flat portion of the bottom surface at the second end of the support member being movably supported upon the cement slab frame and with a portion of the cement being removed by the tapered beveling member to form the beveled surface.

One objective of the present invention is to provide a cement slab surface beveling device which effectively reduces the amount of time to professionally form a beveled surface.

Another objective of the present invention is to provide a cement slab surface beveling device which allows the user to effectively and efficiently form a consistent and even beveled surface throughout.

Further objectives and advantages of the present invention will become apparent as the description proceeds and when taken in conjunction with the accompanying drawings wherein:

DETAILED DESCRIPTION OF THE INVENTION

Figure 1:
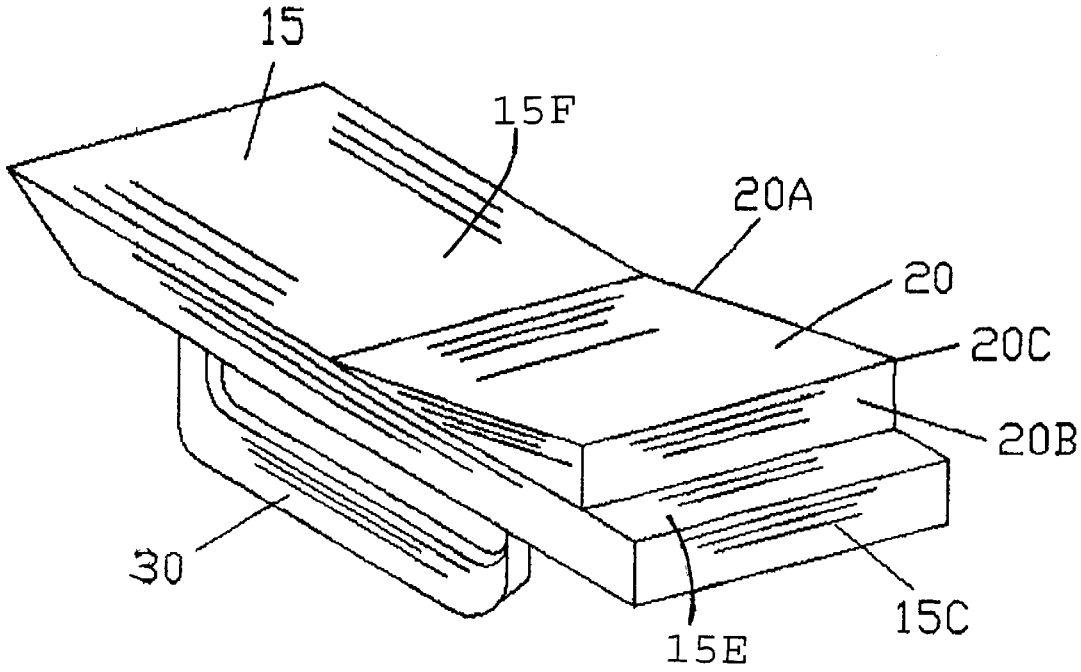
FIG. 1 is a perspective view of the cement slab surface beveling device.
Figure 2:
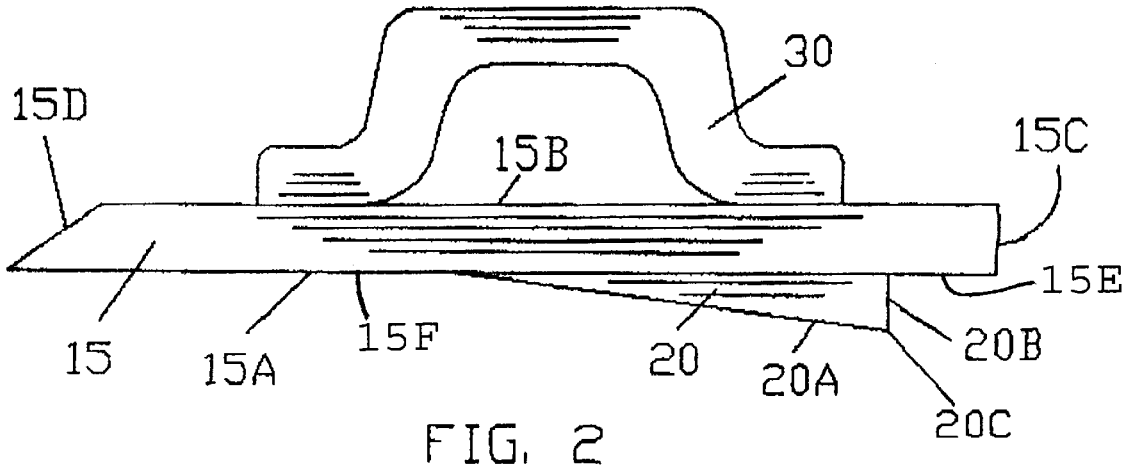
FIG. 2 is a side elevational view of the cement slab surface beveling device.
Figure 3:
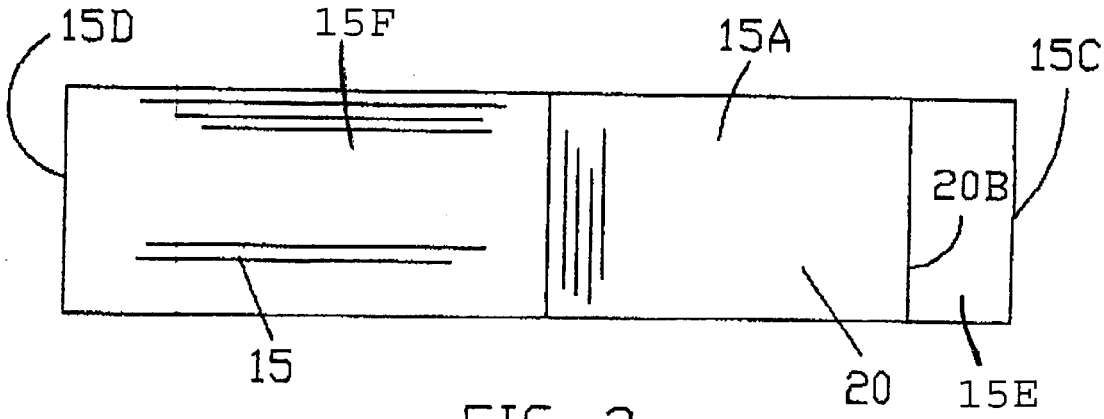
FIG. 3 is a bottom plan view of the cement slab surface beveling device.
Figure 4:
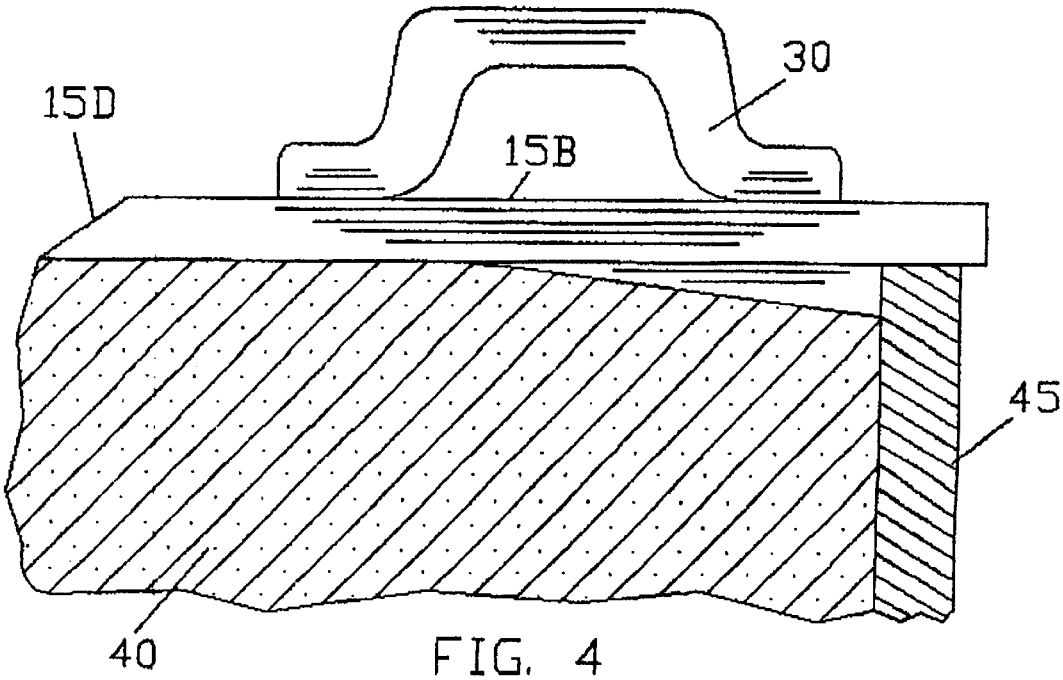
FIG. 4 is a side elevational view of the cement slab surface beveling device being used.

Referring to the drawings in FIGS. 1–4, in particular, the cement slab surface beveling device comprises a plate-like support member 15 having a top side 15B, a bottom surface 15A, a first end 15D and a second end 15C; and further comprises a handle member 30 which is conventionally fastened to and extends outwardly from the top side 15B of the support member 15; and also comprises a beveling member 20 which has substantially the same width as the support member 15 and which is either integral to or securely fastened with conventional fasteners to the bottom surface 15A of the support member 15 and which also has an end 20B which is disposed near but yet spaced from the second end 15C of the support member 15C thus defining a first exposed flat portion 15E of the bottom surface 15A of the support member 15 of approximately an inch between the end of the beveling member 20 and the second end 15C of the support member 15. The beveling member 20 also has a bottom edge 20C which is spaced anywhere from one half inch to two inches from the bottom surface 15A of the support member 15, a flat bottom surface 20A and is tapered such that the flat bottom surface 20A is angled relative to the length of the bottom surface 15A of the support member 15 with the angle being anywhere from 1 degree to 89 degrees. As a further limitation, the flat bottom surface 20A is angled within the range of 2 to 20 degrees relative to the bottom surface 15A of the support member 15. The depth or thickness of the beveling member 20 at the end thereof is anywhere from one half inch to two inches. The flat bottom surface 20A of the beveling member 20 extends from the bottom edge 20C of the beveling member 20 to the bottom surface 15A of the support member 15 preferably intermediate between the first and second ends of the support member 15 thus defining a second exposed flat portion 15F of the bottom surface 15A of the support member 15 between an intermediate portion of the support member 15, where the flat bottom surface 20A of the beveling member 20 terminates, and the first end 15D of the support member 15. But, as an alternate embodiment, the bottom surface 20A terminates at the first end 15D of the support member 15.

In use, the cement slab surface beveling device is primarily used along a selected edge or end of a cement slab 40 with the user placing the first exposed flat portion 15E of the bottom surface 15A movably upon the cement slab frame 45 used to build and form the cement slab 40 with the end 20B of the beveling member 20 essentially contacting a side of the cement slab frame 45 and being disposed in the semi-harden cement 40 and with the second exposed flat portion 15F of the bottom surface 15A of the support member 15 movably contacting the cement slab surface near the selected edge or end thereof. As the user moves the cement slab surface beveling device along the selected edge or end of the cement slab and upon the cement slab frame 45 from one side to the other, the beveling member 20 removes and displaces a portion of the cement with the selected edge or end of the cement slab taking on the beveled and tapered shape of the beveling member 20 as viewed from the side thereof. This particular device allows the user to quickly and effectively form a smooth and even beveled surface throughout like that found along the edge or end of a cement garage floor especially at the entrance thereto. The garage floor is essentially elevated above the ground surface to substantially prevent water from entering upon the garage floor.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A cement slab surface beveling device comprising:

a support member having a top side, a bottom surface, a first end and a second end;

a handle member attached to said support member; and a beveling member being generally tapered and secured to said bottom surface of said support member and having an end, a bottom edge, and a flat bottom surface extending at an angle from said bottom edge to said bottom surface of said support member for forming a beveled surface along an end of a cement slab, said end of said beveling member being spaced from said second end of said support member thus defining a first exposed portion of said bottom surface of said support member between said second end and said end of said beveling member to allow a user to movably support said first exposed portion upon a cement slab frame while forming a beveled surface upon the cement slab, said first exposed portion of said bottom surface being approximately one inch in length, said end of said beveling member being disposed generally perpendicular to said bottom surface of said support member, said end of said beveling member having a depth anywhere from one half inch to two inches for forming a beveled surface upon an end of a cement slab, said bottom edge of said beveling member being spaced anywhere from one half inch to two inches from said bottom surface of said support member, said beveling member having a width generally that of said support member, said flat bottom surface being angled relative to said bottom surface of said support member to form a beveled surface, said flat bottom surface being angled within the range of 2 degrees to 20 degrees relative to said bottom surface of said support member.

2. A cement slab surface beveling device as described in claim 1, wherein said flat bottom surface extends from said bottom edge of said beveling member and terminates at an intermediate portion of said bottom surface of said support member.

3. A cement slab surface beveling device as described in claim 1, wherein said support member further includes a second exposed portion of said bottom surface disposed between said intermediate portion and said first end of said support member for movably contacting a cement slab surface while a beveled surface is being formed.

* * * * *